US010508434B2

(12) United States Patent
Morcous et al.

(10) Patent No.: US 10,508,434 B2
(45) Date of Patent: Dec. 17, 2019

(54) MECHANICAL CONNECTION FOR CONCRETE STRUCTURES

(71) Applicant: NUtech Ventures, Inc., Lincoln, NE (US)

(72) Inventors: George Morcous, Omaha, NE (US); Raed Tawadrous, Winter Springs, FL (US)

(73) Assignee: NUtech Ventures, Lincoln, NE (US)

( * ) Notice: Subject to any disclaimer, the term of this patent is extended or adjusted under 35 U.S.C. 154(b) by 0 days.

(21) Appl. No.: 16/111,479

(22) Filed: Aug. 24, 2018

(65) Prior Publication Data

US 2019/0063060 A1 Feb. 28, 2019

Related U.S. Application Data

(60) Provisional application No. 62/550,317, filed on Aug. 25, 2017.

(51) Int. Cl.
*E04B 1/04* (2006.01)
*E04B 1/41* (2006.01)

(52) U.S. Cl.
CPC ..... *E04B 1/4128* (2013.01); *E04B 1/043* (2013.01); *E04B 1/415* (2013.01)

(58) Field of Classification Search
CPC ..... E04B 1/043; E04B 5/023; E04B 1/215; E04B 5/43; E04B 1/04; E04B 1/41; E01D 19/125; E01D 2101/268; E01C 11/14
See application file for complete search history.

(56) References Cited

U.S. PATENT DOCUMENTS 3,600,863 A * 8/1971 Nachtsheim ..... E04B 1/215 52/483.1
3,722,160 A * 3/1973 Bentley ..... E04B 1/215 52/278

(Continued)

FOREIGN PATENT DOCUMENTS

DE 102008052124 A1 4/2010
EP 2468958 A1 6/2012

(Continued)

OTHER PUBLICATIONS

European Patent Office, International Search Report in International Patent Application No. PCT/US2018/047866, 5 pp. (dated Oct. 31, 2018).

(Continued)

*Primary Examiner* — Brian D Mattei
*Assistant Examiner* — Daniel J Kenny
(74) *Attorney, Agent, or Firm* — Leydig, Voit & Mayer, Ltd.

(57) ABSTRACT

A system and method for connecting precast concrete structures includes anchoring a sleeve within a pocket formed in one of the concrete structures, and placing the concrete structures in contact with one another such that the pocket is diposed around a protruding end of a shear connector embedded in the other concrete structure. A bridge is inserted around the protruding end of the shear connector and a fastener is installed onto the protruding end of the shear connector to engage the bridge and urge the bridge in abutting relation with a lip of the sleeve. The pocket is then filled with a grout.

20 Claims, 4 Drawing Sheets

(56) References Cited

U.S. PATENT DOCUMENTS

| | | | | | |
|---|---|---|---|---|---|
| 3,780,480 | A * | 12/1973 | Cvijanovic | E04B 1/215 | 52/223.4 |
| 3,884,005 | A * | 5/1975 | Wey | E04B 1/043 | 52/583.1 |
| 4,624,086 | A * | 11/1986 | MacKay | E04G 15/061 | 248/56 |
| 4,945,704 | A * | 8/1990 | Brown, Jr. | E04C 5/168 | 52/699 |
| 5,826,290 | A * | 10/1998 | Kokonis | E01D 19/125 | 14/73.1 |
| 8,171,678 | B2 * | 5/2012 | Stanford | E02D 35/00 | 52/125.5 |
| 8,393,128 | B2 * | 3/2013 | Klersy | E04B 1/34823 | 52/259 |
| 10,106,972 | B1 * | 10/2018 | Sarda | E04B 1/21 | |
| 10,156,068 | B2 * | 12/2018 | Cuerrier Auclair | E04B 5/23 | |
| 2004/0074183 | A1 * | 4/2004 | Schneider, III | E01D 19/125 | 52/334 |
| 2004/0146345 | A1 | 7/2004 | Consolazio et al. | | |
| 2007/0199264 | A1 * | 8/2007 | Gruen | E04G 23/0218 | 52/250 |
| 2009/0277124 | A1 * | 11/2009 | Park | E01D 19/125 | |
| 2019/0071871 | A1 * | 3/2019 | Yin | E04C 5/0645 | |

FOREIGN PATENT DOCUMENTS

| | | | |
|---|---|---|---|
| FR | 2714406 | A1 | 6/1995 |
| WO | WO 2007/059542 | A1 | 5/2007 |

OTHER PUBLICATIONS

European Patent Office, Written Opinion in International Patent Application No. PCT/US2018/047866, 8 pp. (dated Oct. 31, 2018).

European Patent Office, International Search Report in International Patent Application No. PCT/US2018/047866, 5 pp. (dated Dec. 31, 2018).

European Patent Office, Written Opinion in International Patent Application No. PCT/US2018/047866, 8 pp. (dated Dec. 31, 2018).

* cited by examiner

MECHANICAL CONNECTION FOR CONCRETE STRUCTURES

CROSS-REFERENCE TO RELATED APPLICATIONS

This patent application claims the benefit of U.S. Provisional Patent Application No. 62/550,317, filed Aug. 25, 2017, which is incorporated herein by reference in its entirety.

FIELD OF THE DISCLOSURE

The present disclosure relates to connections for precast concrete structures and, more particularly, to a shear connection using a shear pocket formed in a precast concrete slab and a support girder or beam.

BACKGROUND OF THE DISCLOSURE

In precast concrete construction of bridges and buildings, it is highly desirable to connect deck/slab panels to the supporting girders/beams to create composite sections for economical design and reduced structural depth. Existing connections are field cast/grouted channels or pockets in the precast concrete panels that enclose shear connectors projecting from the precast concrete girders/beams. The performance of these connections is highly dependent on the quality of grouting material. Also, none of the these connections mechanically connects the components due to their imperfect alignment and relatively high construction tolerance.

BRIEF SUMMARY OF THE DISCLOSURE

In one aspect, the present disclosure is directed to a connection assembly for fastening a first precast concrete member to a second precast concrete member, which are in physical contact with one another. The connection assembly includes a threaded rod protruding from a first face of the first precast concrete member, which first face of the first concrete member contacts the second precast concrete member. A sleeve has a lateral wall surrounding an opening formed in the second precast concrete member. The sleeve is integrated into the second precast concrete member such that the opening extends through a thickness of the second precast concrete member. The second precast concrete member is disposed in contact with the first precast concrete member such that the threaded rod extends at least partially through the sleeve. A lip is connected along an inner side of the lateral wall, and a bridge is disposed within the opening. The bridge has a body that forms a bore disposed around at least a portion of the threaded rod and ends that abut against the lip. A fastener is engaged with the threaded rod and positioned to retain the bridge in contact with the lip.

In another aspect, the disclosure describes a method for connecting a first precast concrete member with a second precast concrete member. The method includes placing the first precast concrete member in contact with the second precast concrete member; providing a threaded protruding from a first face of the first precast concrete member, the first face of the first concrete member contacting the second precast concrete member; providing a sleeve having a lateral wall surrounding an opening, the sleeve being integrated into the second precast concrete member such that the opening extends through a thickness of the second precast concrete member. The method further includes placing the second precast concrete in contact with the first precast concrete member such that the threaded rod extends through the sleeve; placing a bridge within the opening, the bridge having a body that forms a bore disposed around at least a portion of the threaded rod, and ends that abut against a a lip connected along an inner side of the lateral wall; and engaging the threaded rod with a fastener such that the bridge is retained in contact with the lip.

In yet another aspect, the disclosure describes a method for connecting a concrete slab to a support. The method includes anchoring a tube around a pocket in the concrete slab; placing the pocket around a protruding end of a shear connector embedded in an end of the support; inserting a bridge around the protruding end of the shear connector; installing a fastener onto the protruding end of the shear connector to engage the bridge and urge the bridge in abutting relation with a lip of the tube; and filling the pocket in the concrete slab with a grout or flowable concrete material around the bridge.

BRIEF DESCRIPTION OF THE SEVERAL VIEWS OF THE DRAWING(S)

DETAILED DESCRIPTION

The present disclosure describes a system and method to mechanically connect precast concrete components while accommodating production and construction tolerances. The illustrated embodiments significantly enhance the structural performance of the connection and eliminate dependence on the strength of grouting materials.

Figure 1:
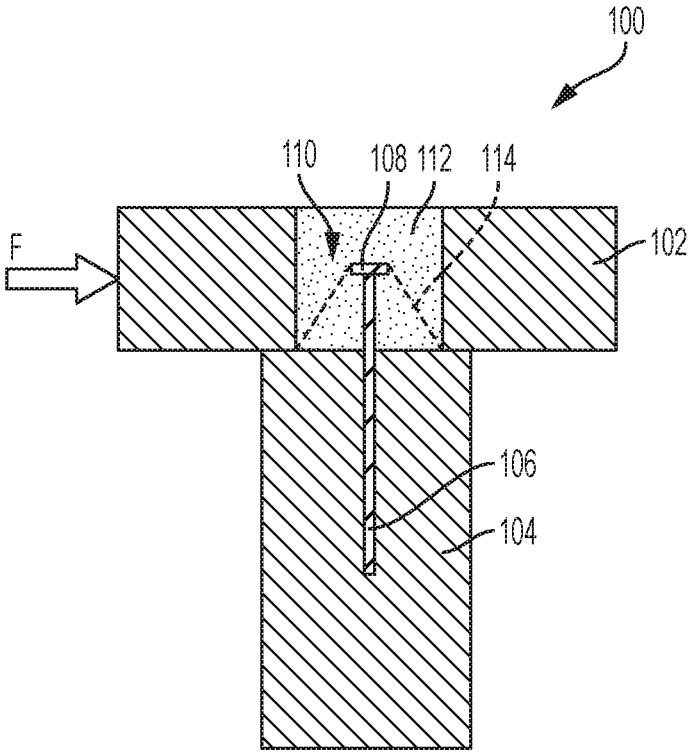
FIG. 1 is a schematic view in cross section of a known connection configuration between a slab and a support beam.

To illustrate at least some disadvantages of the currently used connection arrangements, a cross section schematic of a typical connection 100 is shown in FIG. 1. The connection 100 is made to resist shear loading resulting from a force, F, applied on a slab 102 in a horizontal direction. The slab 102 is supported on and connected to a beam 104, which is embodied as a concrete pillar but which may be embodied in any suitable fashion such as a metal girder and the like. For connecting the slab 102 to the beam 104, a pocket 110 is formed in the slab 102, which accommodates a protruding portion 108 of a shear connector 106. The shear connector 106 is embedded or otherwise connected at one end in the beam 104, and includes a free end protruding into the pocket 110. To complete the connection, a grout 112 or other material such as flowable concrete fills the pocket 110 and solidifies around the protruding portion 108. One disadvantage of the connection 100 is that the strength or rigidity of the connection depends on the rigidity and strength of the grout 112, since failures of such connections are often attributed to a crack or separation failure along a line, such as line 114, that appears within the grout 112.

Figure 2:
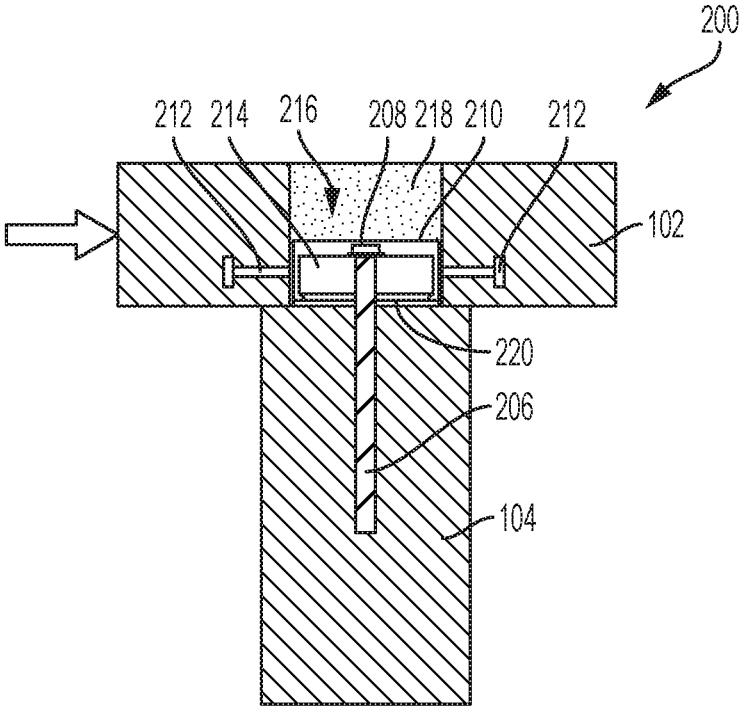
FIG. 2 is a schematic view in cross section of a mechanical connection configuration in accordance with the disclosure.
Figure 3:
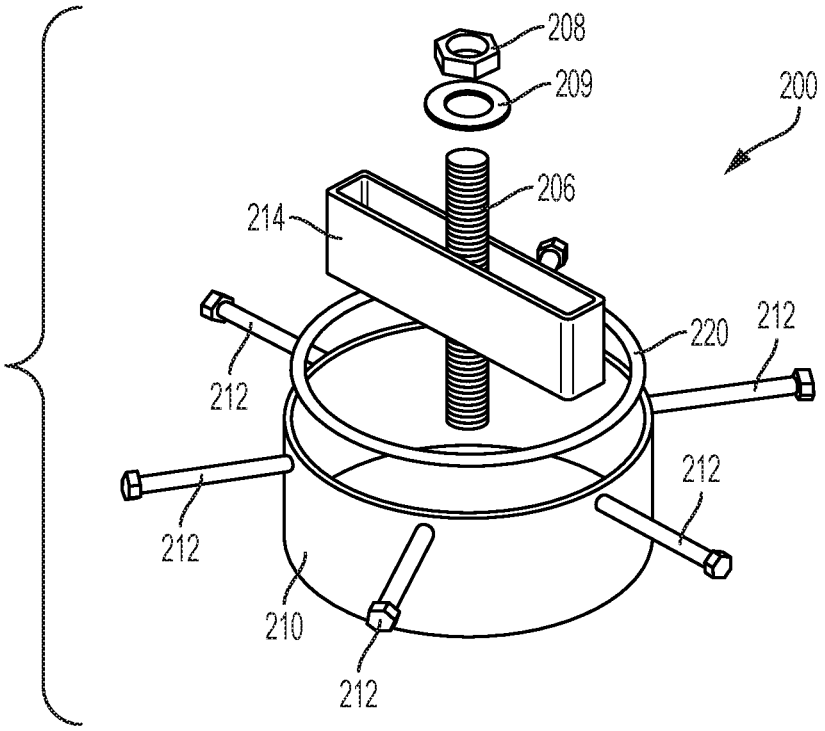
FIG. 3 is an exploded perspective view of a mechanical connection assembly in accordance with the disclosure.
Figure 4:
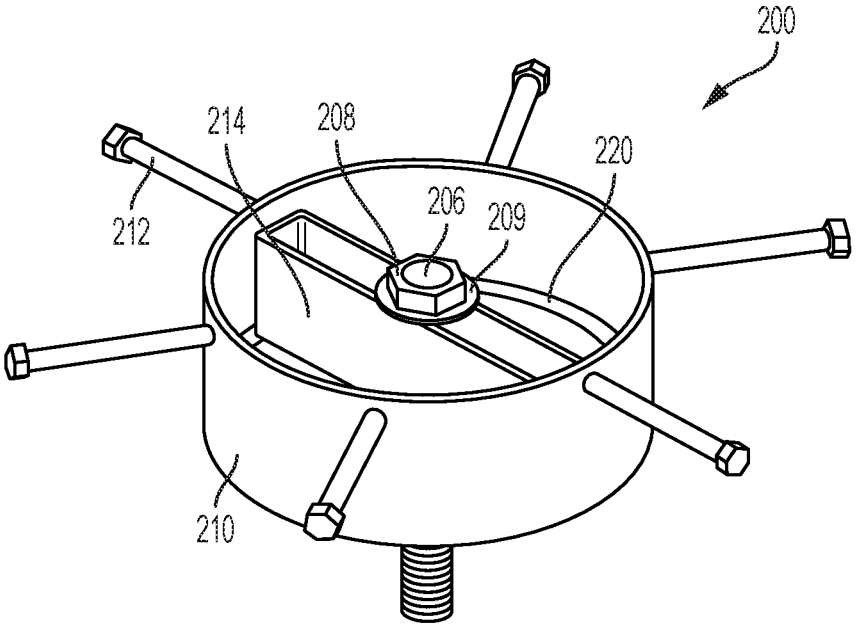
FIG. 4 is an assembled perspective view of the mechanical connection assembly of FIG. 3.

In contrast to the typical connection 100, a connection 200 in accordance with the disclosure is shown in cross section in FIG. 2. The connection is also shown from various perspectives in FIGS. 3, 4 and 5. In reference to these figures, the connection 200 includes a tube 210 having anchors 212 extending radially therefrom. The tube 210, which in the illustrated embodiment is basically a hollow structural section (HSS) that is cast into the slab 102 such that the anchors 212 are embedded in the concrete of the slab 102 and an interior of the tube 210 forms a bottom portion of a pocket 216 of the slab 102. Adjacent a lower end of the tube 210 or, stated differently, an end of the tube 210 that faces the beam 104 to which the slab 102 is connected, the tube 210 includes a lip 220, which is illustrated as a ring or thin bar that is connected to the tube 210.

During assembly, the tube 210 is provided already cast into the slab 102. The slab 102 is hoisted into place and set onto the beam 104 such that the pocket 216 and tube 210 are placed around a protruding end of a shear connector 206, which is illustrated as a threaded rod. A bridging tube 214 is inserted around the shear connector 206 and within the tube 210 until seated against the lip 220. A fastener such as a nut 208, with an optional washer 209, engages an end of the shear connector 206 that protrudes past the bridging tube 214 and is tightened against the bridging tube 214. In this fashion, the bridging tube 214 restrained along the shear connector 206 between the lip 220 and the nut 208 and, therefore, the slab 102 by its connection to the tube 210 is mechanically connected to the beam 104 via the connection 200. More specifically, a torque applied to the nut 208 to tighten the same against the bridging tube 214 creates a clamping force in the body of the shear connector 206 tending to pull in an upward direction in the orientation shown in FIG. 2, and a reactionary clamping force is transferred between the slab 102 and beam 104 from the bridging tube 214, to the lip 220, to the tube 210 and to the slab 102 via the anchors 212 connected to the tube 210. Following assembly, the pocket 216 may be filled with grout 218 to produce a finished slab surface.

Figure 5:
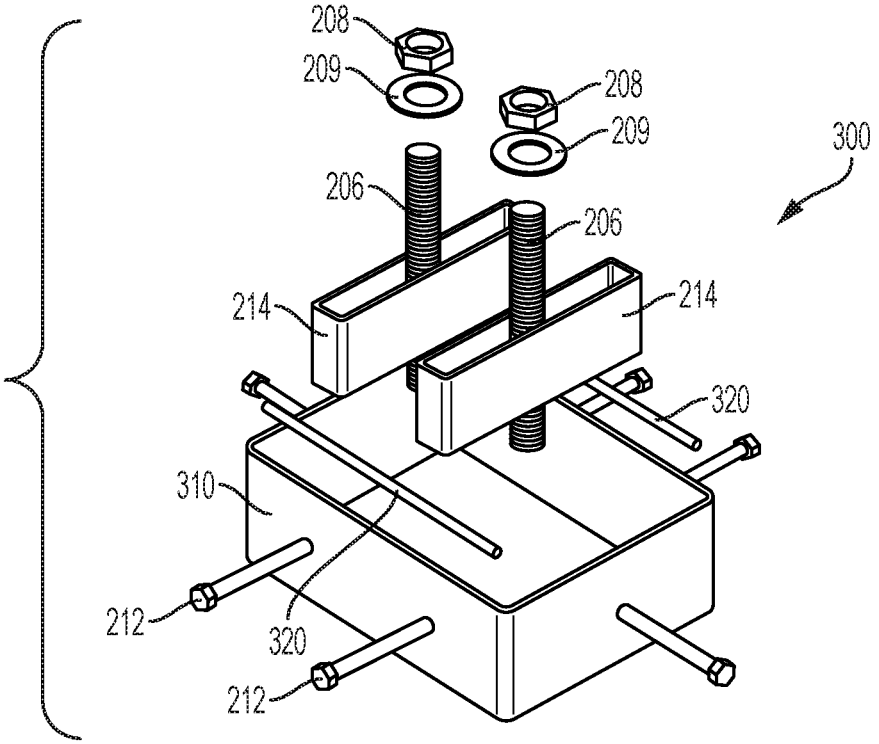
FIG. 5 is an exploded perspective view of an alternative embodiment for a mechanical connection assembly in accordance with the disclosure.
Figure 6:
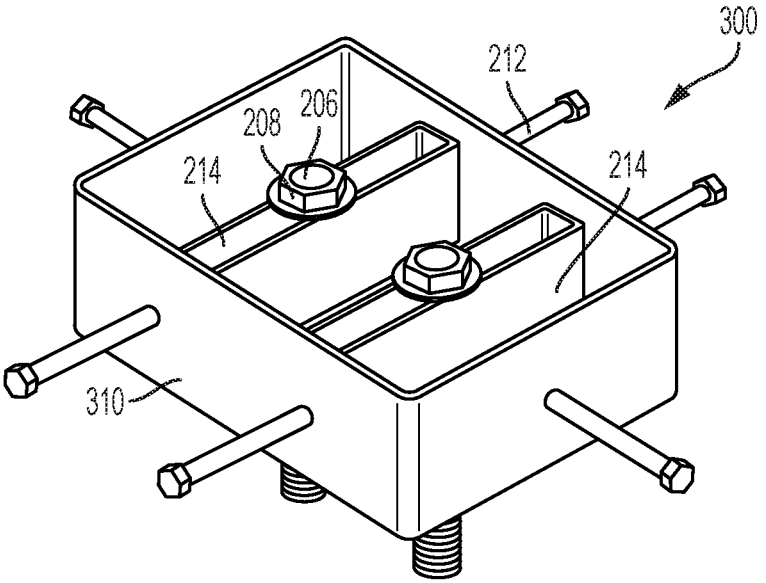
FIG. 6 is an assembled view of the mechanical connection assembly of FIG. 5.

An alternative embodiment for a connection 300 is shown in FIGS. 5 and 6. In reference to these figures, where structures that are the same or similar to structures of connection 200 are denoted by the same reference numerals for simplicity, the connection 300 includes a tube 310. In this embodiment, the tube 310 has a rectangular shape rather than the circular shape of tube 210. The tube 310 includes anchors 212 extending laterally outwardly therefrom in all directions. The tube 310, which in the illustrated embodiment is basically a hollow structural section (HSS) that is cast into the slab 102 such that the anchors 212 are embedded in the concrete of the slab 102 and an interior of the tube 310 forms a bottom portion of a pocket 316 of the slab 102. Adjacent a lower end of the tube 310 or, stated differently, an end of the tube 310 that faces the beam 104 to which the slab 102 is connected, the tube 310 includes a lip 320, which is illustrated as a pair of rods that are connected in parallel on one side of opposite faces of the tube 310.

During assembly, the tube 310 is provided already cast into the slab 102. The slab 102 is hoisted into place and set onto the beam 104 such that the pocket 316 and tube 310 are placed around a protruding end of a pair of shear connectors 206, which are illustrated as threaded rods. A bridging tube 214 is inserted around each of the shear connectors 206 and within the tube 310 until seated against the lips 320. A fastener such as a nut 208, with an optional washer 209, engages an end of each tie 206 that protrudes past each bridging tube 214 and is tightened against the bridging tube 214. In this fashion, the connection between a slab 102 and beam 104 can be accomplished as described above.

The connections 200 and 300 present numerous advantages over the known connections 100. For example, failure in a connection 100 will typically be a brittle failure of the grout used to fill the pocket. In the connections 200 and 300, failure will be a ductile failure of the mechanical parts participating in the connection between the tube (slab) and the shear connector (beam). Additionally, the improved connections allow for increased tolerance in the alignment of the slab to the beam, faster construction, easy implementation and are more durable owing to the ductile fractures that are required to fail the joint. The connections 200 or 300, or other similar arrangements, can be used for pre-cast applications such as bridge construction, and can also be used in other types of applications requiring connections, such as in structural building, precast residential and commercial housing, flooring, roofing and other applications.

To realize the advantages of connections in accordance with the disclosure, experiments were carried out. Based on the results of the experimental and analytical investigations conducted in this research, the researchers developed the new connection detail that eliminates the brittle failure mechanism of concrete breakout, which is commonly experienced in large-sized shear pockets. One difference between the new connection and ones previously proposed or currently in use is the load path between the slab and beam. In the new connection, load is transferred from the HSS-formed tube in the shear pocket to the shear connector mechanically using a bridging tube placed around the shear connector and on a loop bar welded to the tube of the shear pocket, as shown in FIG. 2. The loop bar or lip is welded to the bottom of the tube by fillet welding at discrete locations to support the bridging tube after the threaded rod nut is tightened. This locking mechanism allows the shear connector and precast concrete slab to be connected without fringing on the specified tolerance. Shear studs are also welded to the exterior surface of the tube to provide the necessary anchorage into the slab concrete.

For assembling the connection, first, the precast concrete slab is erected on top of the supporting beam; second, the bridging tube is placed inside the shear pocket and around the shear connector to be supported on the lip; and third, the washer and nut are placed and tightened.

Two specimens corresponding to connection 100 (FIG. 1) and connection 200 (FIG. 2) were tested to evaluate the performance of the new connection. One 1.5 in. diameter A193 B7 threaded rod was used as shear connector. Round HSS 12.75×0.25 with #4 loop bar was used for the tube and lip, respectively, and rectangular HSS 12×2×0.25 was used for bridging tube. Self-consolidating concrete (SCC) was used to fill the shear pocket with an average slump flow of 24 in. The two specimens were tested 40 days after casting the shear pocket and the average measured concrete compressive strength at the testing time was 6.5 ksi. Same test setup and testing procedures were used in testing the two specimens. The load was applied incrementally at an average of 3 kips/sec. The specimen corresponding to connection 200 failed by shearing off the threaded rod without any damage to the concrete inside the shear pocket. The relative displacement was measured between the precast concrete slab and beam in the horizontal direction. The specimens corresponding to connection 200 of the present disclosure started to experience significant horizontal displacement under a constant load when the load reached 150 kips and the corresponding horizontal displacement was 0.09 in. The specimens failed at an average maximum load of 192.4 kips and a corresponding horizontal displacement of 1.66 in.

In contrast, the specimen corresponding to connection 100 (FIG. 1) failed in a brittle mode of failure (concrete breakout failure) and the post yielding resistance was not achieved. The new connection was determined to have increased the connection resistance by an average of 24% when it was compared to the conventional shear pocket connection. In addition, the new connection concept provided ductile mode of failure compared to the brittle mode of failure observed in the conventional shear pocket connection.

Figure 7:
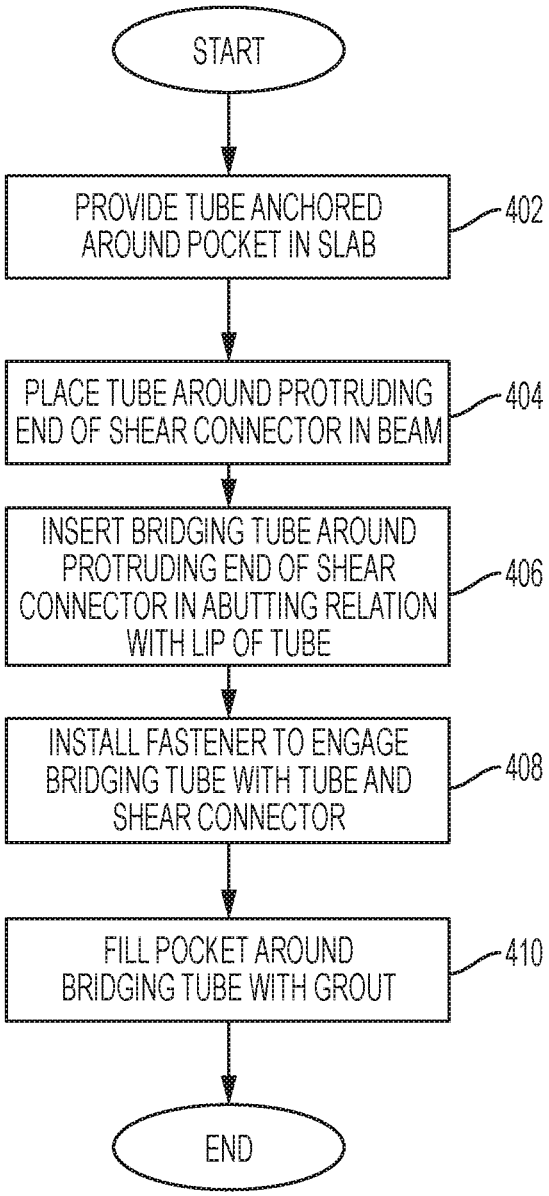
FIG. 7 is a flowchart for a method in accordance with the disclosure.

A flowchart for a method of connecting a concrete structure to a support is shown in FIG. 7. In accordance with the method, a tube is provided and anchored around a pocket in a concrete slab at 402. The pocket is placed around a protruding end of a shear connector embedded in the beam at 404. A bridging tube is inserted around the protruding end of the shear connector and in abutting relation to a lip of the tube at 406. A fastener is installed to engage the bridging tube between the tube and the shear connector at 408, and the pocket is filled with a grout/flowable concrete around the bridging tube at 410.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A connection assembly for fastening a first precast concrete member to a second precast concrete member, the first and second precast concrete members being in physical contact with one another, the connection assembly comprising:

a threaded rod protruding from a first face of the first precast concrete member, the first face of the first concrete member contacting the second precast concrete member;

a sleeve having a lateral wall surrounding an opening, the sleeve being integrated into the second precast concrete member such that the opening extends through a thickness of the second precast concrete member, the second precast concrete member being disposed in contact with the first precast concrete member such that the threaded rod extends at least partially through the sleeve;

a lip connected along an inner side of the lateral wall;

a bridge disposed within the opening, the bridge having a body that forms a bore disposed around at least a portion of the threaded rod and ends that abut against the lip; and a fastener engaged with the threaded rod and positioned to retain the bridge in contact with the lip.

2. The connection assembly of claim 1, further comprising one or more concrete anchors connected with the lateral wall of the sleeve along an outer side thereof, the one or more concrete anchors being embedded into the second precast concrete member.

3. The connection assembly of claim 2, wherein each of the one or more concrete anchors has an elongate shape and is connected at one end on the outer side of the lateral wall.

4. The connection assembly of claim 3, wherein each of the one or more concrete anchors has a head connected an an opposite end thereof.

5. The connection assembly of claim 1, further comprising a grout material occupying an internal space of the opening.

6. The connection assembly of claim 1, wherein the lip is connected to the lateral wall and extends around a perimeter of the opening.

7. The connection assembly of claim 6, wherein the lip is disposed adjacent the first precast concrete member.

8. The connection assembly of claim 1, wherein the threaded rod is embedded and anchored at one end in the first precast concrete member.

9. The connection assembly of claim 1, wherein the sleeve has a tubular shape.

10. The connection assembly of claim 1, wherein the sleeve has a round cross section.

11. The connection assembly of claim 1, wherein the sleeve has a rectangular cross section.

12. The connection assembly of claim 1, wherein the body of the bar has an elongate shape that abuts the lip at two locations.

13. The connection assembly of claim 1, wherein the sleeve, the lip, and the bridge are made of steel.

14. A method for connecting a first precast concrete member with a second precast concrete member, comprising:

placing the first precast concrete member in contact with the second precast concrete member;

providing a threaded protruding from a first face of the first precast concrete member, the first face of the first concrete member contacting the second precast concrete member;

providing a sleeve having a lateral wall surrounding an opening, the sleeve being integrated into the second precast concrete member such that the opening extends through a thickness of the second precast concrete member;

placing the second precast concrete in contact with the first precast concrete member such that the threaded rod extends through the sleeve;

placing a bridge within the opening, the bridge having a body that forms a bore disposed around at least a portion of the threaded rod, and ends that abut against a a lip connected along an inner side of the lateral wall;

engaging the threaded rod with a fastener such that the bridge is retained in contact with the lip.

15. The method of claim 14, further comprising connecting one or more concrete anchors to an outer side of the lateral wall of the sleeve, and embedding the one or more concrete anchors into the second precast concrete member.

16. The method of claim 14, further comprising filling an internal space of the opening with a grout material.

17. A method for connecting a concrete slab to a support, comprising:

anchoring a tube around a pocket in the concrete slab;

placing the pocket around a protruding end of a shear connector embedded in an end of the support;

inserting a bridge around the protruding end of the shear connector;

installing a fastener onto the protruding end of the shear connector to engage the bridge and urge the bridge in abutting relation with a lip of the tube; and filling the pocket in the concrete slab with a grout or flowable concrete material around the bridge.

18. The method of claim 17, wherein anchoring the tube around the pocket includes connecting anchors on an outer side of the tube, and casting the concrete slab around the tube and anchors to embed the anchors in the concrete slap and allow an interior of the tube to form the pocket.

19. The method of claim 17, wherein the shear connector is a threaded rod that is embedded in the support, and wherein the fastener is a nut that threadably engages the shear connector.

20. The method of claim 17, further comprising inserting a second bridge around a protruding end of a second shear connector disposed in the pocket, and fastening the second bridge in abutting relation with the lip.

* * * * *